United States Patent [19]

Fischer

[11] Patent Number: 4,530,284

[45] Date of Patent: Jul. 23, 1985

[54] ROTARY PRINTING MACHINE WITH LIQUID SUPPLY APPARATUS COMPRISING AN ENDLESS BAND

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 586,856

[22] Filed: Mar. 6, 1984

[30] Foreign Application Priority Data

Mar. 8, 1983 [DE] Fed. Rep. of Germany ..... 3308067

[51] Int. Cl.[3] ..... B41F 1/46; B41F 31/06; B41F 31/16; B41F 31/20

[52] U.S. Cl. ..... 101/350; 101/148; 101/207; 101/209; 101/352; 101/DIG. 7; 118/257

[58] Field of Search ..... 101/132.5, 147, 148, 101/202, 204–210, 327–331, 340–352, 354–361, 363, 364, 367, 425, 451, DIG. 7; 118/257

[56] References Cited

U.S. PATENT DOCUMENTS

| | | | |
|---|---|---|---|
| 3,638,568 | 2/1972 | Granger | 101/352 |
| 3,701,316 | 10/1972 | Sylvester | 101/425 |
| 3,926,116 | 12/1975 | Wildeman | 101/148 |
| 4,130,057 | 12/1978 | List | 101/148 |
| 4,387,647 | 6/1983 | Fischer | 101/352 |
| 4,404,908 | 9/1983 | Simeth | 101/148 |

FOREIGN PATENT DOCUMENTS

| | | | |
|---|---|---|---|
| 1932642 | 10/1964 | Fed. Rep. of Germany | 101/451 |
| 3025546 | 1/1982 | Fed. Rep. of Germany . | |
| 3112745 | 3/1983 | Fed. Rep. of Germany . | |

*Primary Examiner*—Clyde I. Coughenour
*Assistant Examiner*—William L. Klima
*Attorney, Agent, or Firm*—Frishauf, Holtz, Goodman & Woodward

[57] ABSTRACT

A rotary printing machine has a plate cylinder and a liquid supply apparatus comprising an inker and a damper. The liquid supply apparatus includes rollers and an endless band guided over two deflection rollers. The band, which has a surface that accepts ink and damping fluid and extends over the width of the rollers, is provided with guide elements cooperating with counterpart guide elements attached to the machine. The guide elements and counterpart guide elements are embodied such that the band is displaceable at right angles to the axes of two rollers and is additionally pivotable at least about one of the axes of a deflection roller. Positioning means supported firmly on the machine are also provided for fixing the band in at least two different operating positions, in which the band is in contact with one or two rollers of the liquid supply apparatus. As a result of the different screw-down positions of the band that thus become possible, various kinds of disruptions in the supply of liquid to the plate cylinder can be counteracted.

11 Claims, 3 Drawing Figures

ROTARY PRINTING MACHINE WITH LIQUID SUPPLY APPARATUS COMPRISING AN ENDLESS BAND

The invention relates to a rotary printing machine with at least one plate cylinder and a liquid supply apparatus including an inker and a damper. The liquid supply apparatus includes rollers and an endless tape or band guided over two deflection rollers held between two support plates, which have guide elements cooperating with counterpart guide elements attached to the machine.

BACKGROUND

An arrangement of this kind, described in German Patent Disclosure Document DE-OS 31 25 434, has an endless band that is narrower than the rollers and is disposed such that it is displaceable parallel to the axis of the rollers. With this apparatus, in cases where relatively large ink-free zones are found on a plate in the circumferential direction, the disruptive influence of the damping medium that is transferred from these zones to the ink application rollers is supposed to be reduced.

In printing machines operating with ink and damping liquid, a number of problems arise, particularly when different subject matters are to be printed. Thus far, attempts have been made to solve these problems with individual provisions.

When ink and damping liquid are applied separately. the balance between these liquids is quite difficult to attain. It also takes a long time after the printing machine has been stopped before a state of balance is again attained. These disadvantages can be reduced by providing that at least part of the damping liquid be guided via an ink application roller to the plate cylinder. On the other hand, for instance in printing subject matters in which smaller zones that are to be printed alternate with larger, non-printed zones, it is more favorable to supply ink and damping liquid separately, because otherwise a change in the intensity of the ink color can take place because too much damping liquid is supplied. In order to meet these needs, it is already known to provide selectively engageable intermediate rollers between an ink application roller and a damping fluid application roller (see German Utility Model DE-GM 1 932 642).

When working with particularly absorbent paper, normal inkers sometimes do not print with a satisfactory color intensity. In that case it is advantageous to provide an additional ink transport train to an ink application roller (see German Patent Disclosure Document DE-OS 29 42 750).

If furthermore a subject matter to be printed has a section in the circumferential direction that prints over a relatively large surface area and requires a large amount of ink, and this section is adjoined by a non-printing section, the danger of random patterning exists. Inside the section printing over a large surface area, contours printed with an increased color intensity occur. This unattractive effect can be reduced by supplying additional ink from an ink reservoir to an application roller.

With an increasing buildup of emulsion, a pattern can also form on the damping fluid application roller, which then becomes apparent as random patterning on the printed material. The screwing down of a band can prevent the emulsion buildup and reduce the pattern forming on the roller to a minimum.

THE INVENTION

It is accordingly an object of the invention to create an apparatus of simple design, with which various problems in the supply of liquid to the plate cylinder, each of which previously had to be confronted separately by individual provisions, can be counteracted.

Briefly, a tape or band is provided having a surface which accepts ink as well as damping fluid. The tape or band has a width which corresponds at least approximately to the width of rollers about which the tape or band is looped. The rollers are supported on holders, such as holder plates, which can be shifted with respect to the frame of the machine by controllable positioning elements such that the tape or band is brought, selectively, completely out of contact, or in contact, with either or both of a damping fluid application roller and/or an ink application roller forming, selectively, parts of a damper and inker, respectively, and in engagement with the plate cylinder of the machine.

Further characteristics and advantages of the invention will become apparent from the ensuing description of an exemplary embodiment, taken in conjunction with the drawing.

DRAWING

DETAILED DESCRIPTION

Figure 1:
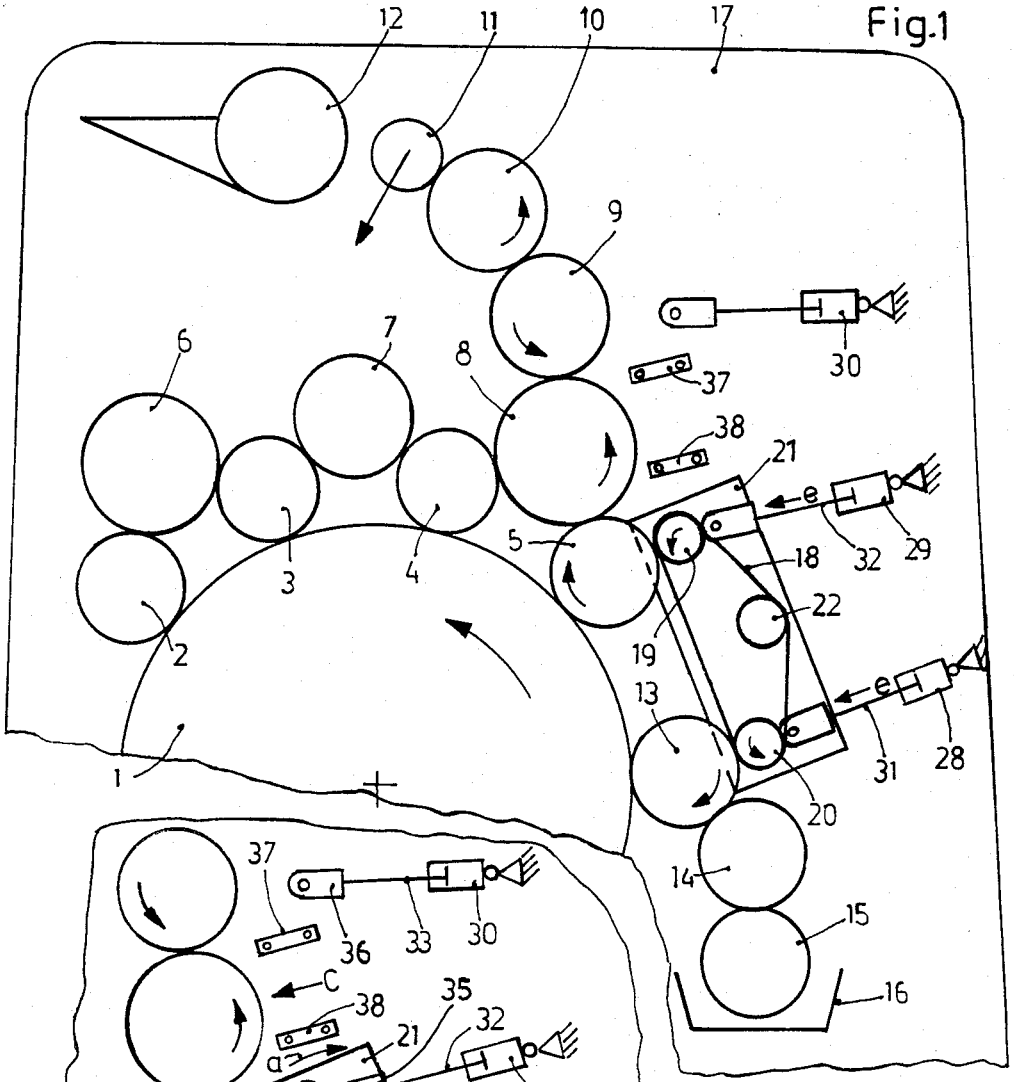
FIG. 1 is a schematic illustration based on a section taken through the central longitudinal axis of the printing machine.

The exemplary embodiment shown has a plate cylinder 1, on which a plurality of ink application rollers 2, 3, 4, 5 rests. The ink application rollers are supplied with ink via further ink train rollers 6–11, the ink being picked up from an ink trough roller 12 by the ink train roller 11. Also resting on the plate cylinder 1 is a damping fluid application roller 13, to which damping fluid, typically water, is supplied via two damper rollers 14, 15 from a damping fluid trough 16.

The plate cylinder 1 and all the rollers mentioned above as well as the damping fluid trough 16 are supported between two side walls 17 of the machine, only one of which is shown.

The rollers 2–12 comprise an inker, known per se, and the rollers 13–15 together with the damping fluid trough likewise comprise a damper known per se. Instead of the inker and damper shown, which together comprise the liquid supply apparatus, inkers or dampers of a different design may be used.

The rotary printing machine shown furthermore has an endless tape or band 18, which is guided between two deflection rollers 19, 20. The band 18 has a surface which accepts ink and damping fluid, being for instance manufactured from rubber, and it extends over the entire length of the rollers of the liquid supply apparatus. The two deflection rollers 19, 20 are supported on each end in a holder element or support plate 21, only one of which is shown. Also supported on the support plate 21, for instance in eccentric bearings, is a tension roller 22 for the band 18.

Figure 2:
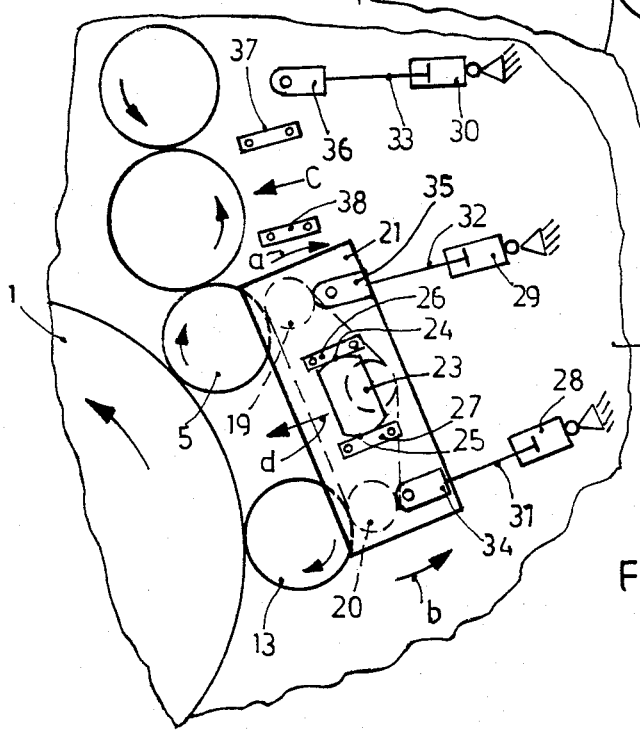
FIG. 2 is an illustration corresponding to FIG. 1, with a view of the outside of a support plate.

On each support plate 21, on the side associated with the respective side wall 17 of the machine, an extension 23 (FIG. 2) is provided, having two convexly curved guide faces 24, 25 which form guide elements for the support plate 21. As seen in FIG. 2, the guide faces 24, 25 are insertable between guide rails 26, 27 in the direction of the arrow d, that is, at right angles to the axes of the rollers 5 and 13, into a first basic position between the two parallel guide rails 26, 27. The guide rails 26, 27 are secured to each side wall 17 of the machine. The guide rails 26, 27 act as counterpart guide elements. Because of the convex embodiment of the guide faces 24, 25, a limited pivoting of each support plate 21 in the direction of the arrow a about the axis of the deflection roller 20 or in the direction of the arrow b about the axis of the deflection roller 19 is possible. Naturally it is also possible to dispose the convex guide faces on the side walls 17 of the machine and to dispose the guide rails on the support plates 21.

In order to hold the support plates 21 firmly in a desired position, positioning means in the form of hydraulic positioning cylinders are pivotably articulated on each side wall 17 of the machine. The positioning rods 31, 32, 33 connected to the piston, shown merely schematically, of the hydraulic positioning cylinders each have a tab 34, 35, 36 on their end, with which they can be secured pivotably to the support plate 21 by means of a bolt, not shown.

In the illustrated exemplary embodiment, besides the pair of guide rails 26, 27, a further pair of guide rails 37, 38 is also provided. These guide rails are again disposed such that the guide faces 24, 25 of each support plate 21 can be inserted in the direction of the arrow c, that is, at right angles to the axes of the rollers 5 and 9, into a second basic position.

OPERATION

If the guide faces 24, 25 are inserted between the guide rails 26, 27, as shown in FIGS. 1 and 2, and if the hydraulic cylinders 28, 29 are subjected to pressure such that their positioning rods move in the direction of the arrow e, then the tape or band 18 comes into contact simultaneously with both the ink application roller 5 and the damping fluid application roller 13. The band 18 therefore connects the inker with the damper. If by contrast the hydraulic cylinder 28 is acted upon such that its positioning rod 31 moves in the direction of the arrow e and the hydraulic cylinder 29 is acted upon such that its positioning rod 32 moves counter to the direction of the arrow e, then the support plate 21 pivots in the direction of the arrow a about the axis of deflection roller 20; then the band 18 rests only on the damping fluid application roller 13 but is out of contact with the ink application roller 5. In this position, the band 18 acts as a reservoir for damping fluid. If the hydraulic cylinders are acted upon in exactly the opposite directions, then the band 18 pivots in the direction of the arrow b about the axis of the deflection roller 19. The deflection roller 19 therefore remains in contact with the ink application roller 5, while the connection between the band 18 and the ink application roller 13 is interrupted. The band 18 accordingly acts as an ink reservoir.

Figure 3:
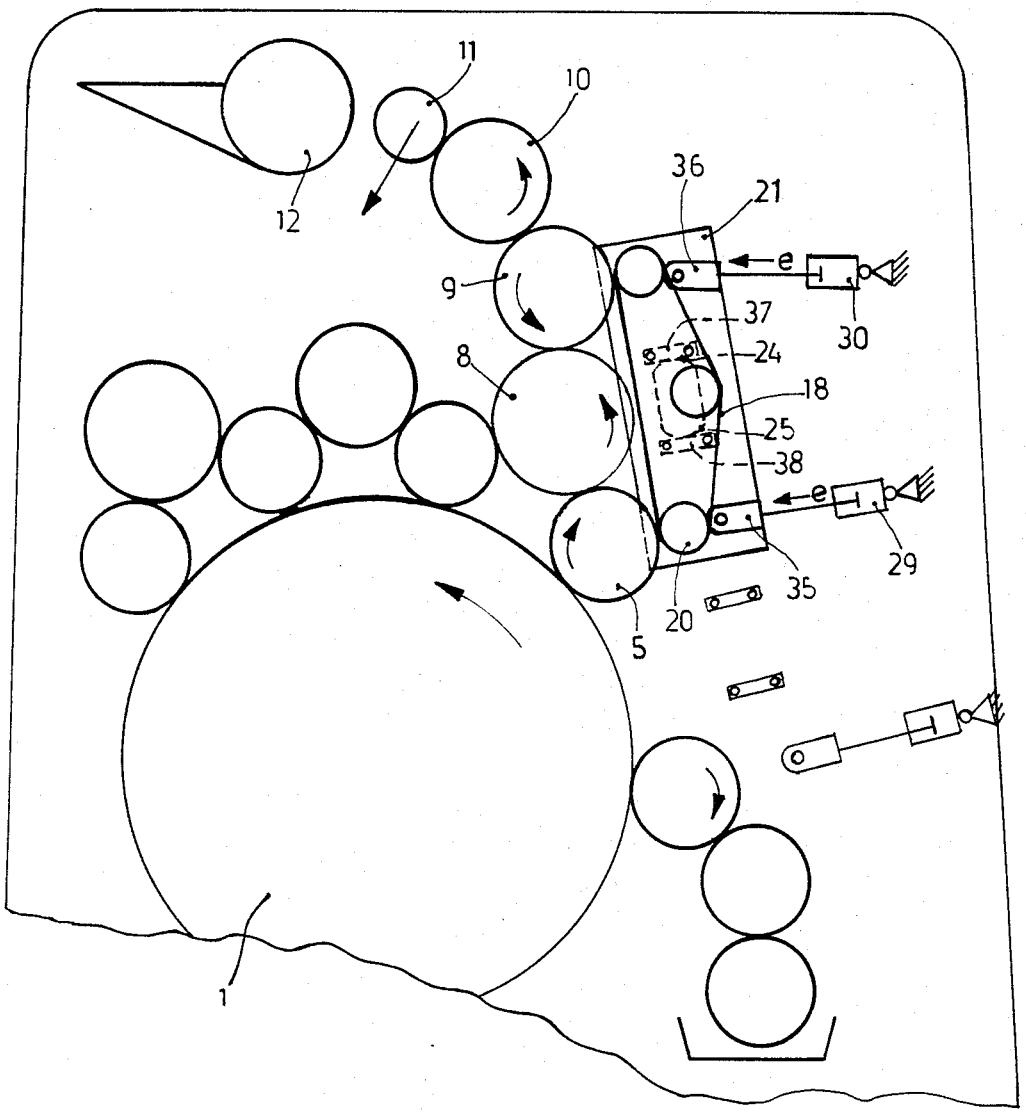
FIG. 3 is an illustration corresponding to FIG. 1, showing the tape or band in a second basic position.

Since the bolt connection between the tabs 34, 35 and each support plate 21 is releasable, the plate 21 can, after these connections have been loosened, be removed out of the guide faces 24, 25 counter to the insertion direction indicated by the arrow d. It is now possible to reverse the support plates 21 with the band 18 and to insert it with its guide faces 24, 25 between the guide rails 37, 38 in the direction of the arrow c. Then the tabs 35, 36 of the hydraulic positioning cylinders 29, 30 are articulated onto the plates 21. Now, after pressure is exerted upon the hydraulic positioning cylinders 29, 30, the possibility exists of putting the band 18 into contact with both the ink application roller 5 and the ink train roller 9 simultaneously, as shown in FIG. 3. In this further basic position, the band 18 represents a further ink transport train to the ink application roller 5. If pressure is exerted upon only the hydraulic positioning cylinder 29 in the direction indicated by the arrow e, while in contrast pressure is exerted upon the hydraulic positioning cylinder 30 in the opposite direction, then the band 18 pivots about the axis of the deflection roller 20 and is thus brought out of contact with the ink train roller 9. In this position, the band 18 acts as an ink reservoir.

A drive mechanism for the band 18 is not required, because during operation it is carried along by frictional engagement with one of the rollers, to which it is screwed down.

The invention is not restricted to the exemplary embodiment shown and described herein. For instance, pneumatic positioning cylinders may be used instead of hydraulic positioning cylinders. In principle, it is also possible to effect the screwing down of the band 18 to the rollers of the damping fluid supply apparatus, and its release therefrom, by means of set screws.

I claim:

1. Rotary printing machine having at least one plate cylinder and a liquid supply apparatus (2-16) including an inker (2-12) and a damper (13-16), the liquid supply apparatus including liquid supply rollers and an endless band guided over two deflection roller (19, 20), the deflection rollers being held between two support plates which have guide elements cooperating with counterpart guide elments attached to the machine, wherein, in accordance with the invention, the band (18) has a surface accepting ink and damping fluid and extends over the width of the fluid supply rollers; support plate guide means (23) associated with said support plates (21) and plural sets of counterpart guide elements (26,27 and 37,38) associated with the machine cooperate such that either set of counterpart guide elements can selectively be engaged by said support plate guide means for select engagement of said endless band with one or two liquid supply rollers and guide elements (24, 25) formed with first engagement surfaces for engaging the counterpart guide elements (26, 27, 37, 38) formed with second engagement surfaces, said first and second engagement surfaces including guide portions and curved portions to permit displacement of the support plates with respect to the machine and hence of the band (18), towards and away from the fluid supply rollers at right angles to the axes of two liquid supply rollers (e.g. 5, 13) and pivoting movement about an axis parallel to the axis of at least one of the deflection rollers (19, 20); and positioning means (28, 29, 30) supported on the machine are provided for fixing the support plates (21) on the counterpart guide elements (26, 27) in at least two different operating positions of the endless band (18), in which positions the band is selectively in contact with one or two rollers (5, 13, 9) of the liquid supply apparatus.

2. Rotary printing machine according to claim 1, wherein each pairing of the engagement surface of the guide elements and counterpart guide elements includes two parallel guide rails (26, 27, 37, 38) extending toward the fluid supply rollers and two convexly curved guide surfaces (24, 25), forming the curved portions cooperating with the guide rails.

3. Rotary printing machine according to claim 1, wherein the positioning means are embodied as hydraulic or pneumatic positioning cylinders (28, 29, 30), the positioning rods (31, 32, 33) of which are articulatable on at least one of the support plates (21).

4. Rotary printing machine according to claim 1, wherein two positioning means (28, 29, 30), each engaging one end of the plate (21), are articulatable on the support plate (21).

5. Rotary printing machine according to claim 1, wherein the counterpart guide means (26, 27) and positioning means (28, 29) are positioned and arranged such that the band (18) located between the support plates (21) is translatable into a first basic position, in which it connects an ink application roller (5) and a damping fluid application roller (13), and is selectively pivotable out of engagement with one of the ink application rollers (5) and the damping fluid application roller (13).

6. Rotary printing machine according to claim 1, wherein the counterpart guide means (37, 38) and positioning means (29, 30) are positioned and arranged such that the band (18) held by the support plates (21) is translatable into a second basic position, in which it connects an ink application roller (5) and an ink train roller (9) with one another and can be pivoted out of engagement with the ink train roller.

7. Rotary printing machine according to claim 5, wherein the band (18) is selectively translatable into one of the two basic positions.

8. Rotary printing machine according to claim 6, wherein the band (18) is selectively translatable into one of the two basic positions.

9. Rotary printing machine according to claim 1, wherein the band (18) is movable in a coupled manner by frictional engagement.

10. Rotary printing machine according to claim 1, wherein an adjustable tension roller (22) is provided between the deflection rollers (19, 20) on the support plate (21).

11. Rotary printing machine having a machine frame (17);

a plate cylinder (1);

a liquid supply apparatus to supply a liquid which includes:

ink;

damping liquid;

to the plate cylinder (1), said apparatus including an endless tape or band (18);

two turn-around and deflection rollers (19, 20) about which the endless tape or band is looped;

a pair of movable spaced holder elements (21) securing the axial ends of the rollers (19, 20) in position;

interengaging guide means (24, 25; 26, 27, 37, 38) connecting the holder elements and the machine frame for guiding and positioning movement of the holder elements;

and two liquid application rollers (5, 13) in engagement with the plate cylinder, wherein, in accordance with the invention, the tape or band (18) has a surface which accepts both ink and damping fluid;

the width of the tape or band corresponds at least approximately to the width of the liquid application rollers (5, 13);

the guide means are shaped to permit shifting movement of the tape or band, selectively, perpendicular to the axes of said two liquid application rollers and, additionally, for pivotal movement about the axis of at least one of the turn-around and deflection rollers (19, 20);

and wherein movable band positioning means (28, 29, 30) are provided, supported on the machine frame (17) and coupled to the holder elements (21) to, selectively, move the holder elements, and hence the tape or band, selectively into or out of engagement with none, one, or both of the liquid application rollers (5, 13).

* * * * *